US007923978B2

(12) United States Patent
Kawashima et al.

(10) Patent No.: US 7,923,978 B2
(45) Date of Patent: Apr. 12, 2011

(54) REGULATOR CIRCUIT HAVING OVER-CURRENT PROTECTION

(75) Inventors: Shinji Kawashima, Ohtsu (JP); Kazunori Doi, Ohtsu (JP)

(73) Assignee: Renesas Electronics Corporation, Kanagawa (JP)

( * ) Notice: Subject to any disclaimer, the term of this patent is extended or adjusted under 35 U.S.C. 154(b) by 373 days.

(21) Appl. No.: 12/113,496

(22) Filed: May 1, 2008

(65) Prior Publication Data

US 2008/0272753 A1 Nov. 6, 2008

(30) Foreign Application Priority Data

May 1, 2007 (JP) ..... 2007-121030

(51) Int. Cl.
*G05F 1/573* (2006.01)

(52) U.S. Cl. ..... 323/277; 363/50

(58) Field of Classification Search ..... 323/226, 323/269, 273–281, 303; 363/50
See application file for complete search history.

(56) References Cited

U.S. PATENT DOCUMENTS 5,512,814 A * 4/1996 Allman ..... 323/267
7,183,755 B2 * 2/2007 Itoh et al. ..... 323/274
2006/0250740 A1 11/2006 Itoh et al.

FOREIGN PATENT DOCUMENTS

JP 2001-306163 11/2001

OTHER PUBLICATIONS

Chinese Official Action-200810094933.6-Dec. 21, 2010.

* cited by examiner

*Primary Examiner* — Harry Behm
*Assistant Examiner* — Matthew Grubb
(74) *Attorney, Agent, or Firm* — Young & Thompson

(57) ABSTRACT

A stabilized regulator circuit is provided A first Pch transistor (PTr) (P1) whose source is connected to a power supply line and whose drain is connected to an output terminal that outputs a load current, a PTr (P2) whose source and gate are respectively connected to the source and gate of the PTr (P1), resistor elements connected in series between the output terminal and ground, a resistor element (R3) connected between a drain of P2 and ground, and an amplifier which controls P1 and P2 based on a difference between potential of a connection point of the resistor elements and a reference. A comparator, with a differential amplifier input stage configured by an Nch transistor, compares potential difference between two ends of R3 and potential difference between the connection point of the resistor elements and ground, and when the former is larger, controls P1 so as to limit load current.

4 Claims, 8 Drawing Sheets

R104
PMOS4
101
PMOS1
PMOS2
+
−
102
103
PMOS3
R101
NMOS
R102
R103

REGULATOR CIRCUIT HAVING OVER-CURRENT PROTECTION

REFERENCE TO RELATED APPLICATION

This application is based upon and claims the benefit of the priority of Japanese Patent Application No. 2007-121030, filed on May 1, 2007, the disclosure of which is incorporated herein in its entirety by reference thereto.

FIELD OF THE INVENTION

The present invention relates to a regulator circuit and in particular to a regulator circuit with an overcurrent protection circuit configured such that an output unit and a current detection unit are partitioned.

Normally, a direct current stabilizing power supply circuit (a regulator circuit) is built into an electronic device. In many cases, an overcurrent protection circuit is built into a power supply circuit to detect an overcurrent state or an output short state, to protect the power supply circuit from thermal destruction and the like. An upper limit of voltage inputted to the power supply circuit is restricted to voltage tolerance of a part used, and a lower limit is restricted to operation voltage of the power supply circuit. If a current greater than or equal to a fixed level is detected for any range of input voltage with which operation is possible, an overcurrent protection function that restricts output is necessary.

A regulator circuit provided with such an overcurrent protection function is disclosed in Patent Document 1. The regulator circuit, as shown in FIG. 8, includes: an operational amplifier 102, a regulator input terminal 101 which receives a band gap reference voltage to a non-inverted input terminal (+) of the operational amplifier 102, a resistor R101 connected between an output terminal 103 and a resistor R102 connected between ground and a PchMOS transistor PMOS3 whose gate is connected to an inverted input terminal (−) of the operational amplifier 102, PchMOS transistors PMOS1 and PMOS2 whose gates are connected to an output terminal of the operational amplifier 102, the output terminal 103 connected to a drain of the PchMOS transistor PMOS2, the PchMOS transistor PMOS3 whose source is connected to a drain of the PchMOS transistor PMOS1, the resistor R103 connected between ground and an NchMOS transistor NMOS whose gate is connected to a drain of the PchMOS transistor PMOS3, a PchMOS transistor PMOS4 whose gate and drain are connected respectively to a drain of the NchMOS transistor NMOS and a gate of the PchMOS transistor PMOS1, and a resistor R104 connected between the drain of the NchMOS transistor NMOS and a power supply.

According to this type of regulator, when an output current reaches a shutdown set value, the NchMOS transistor NMOS becomes conductive, and the PchMOS transistor PMOS4 becomes conductive. Therefore, since a gate voltage of the PchMOS transistor PMOS2 jumps up to a power supply voltage level, output current is shut off, and an overcurrent protection function is realized. Furthermore, by providing a plurality of output unit transistors, as with PMOS1 and PMOS2, and partitioning the output unit and the current detection unit, and voltage drop from the power supply voltage is as small as possible, and thus a low power supply voltage operation is possible. Moreover, by using a resistor in the current detection unit, a resistance value can be arbitrarily set without direct relationship with output current.

Patent Document 1: JP Patent Kokai Publication No. JP-P2001-306163

SUMMARY OF THE INVENTION

The following analyses are given by the present invention. The entire disclosure of above Patent Document is incorporated herein by reference thereto.

However, the regulator circuit of FIG. 8 is configured so as to detect overcurrent by a threshold of the NchMOS transistor NMOS. In a threshold of a MOS transistor there is variation due to individual difference, and there is variation with temperature. Therefore, there is a risk that the shutdown set value (detection value of overcurrent) will vary due to difference in individual products and temperature.

Furthermore, to detect overcurrent by the threshold of the NchMOS transistor NMOS, a current equivalent to a detected value of the overcurrent continues to flow even in a state in which output shorts. Therefore, a protection function of a device that is provided with a regulator circuit is not necessarily sufficient.

According to one aspect of the present invention, there is provided a regulator circuit including: an output terminal which outputs a load current; a first MOS transistor whose source is connected to a first power supply line and whose drain is connected to an output terminal; a second MOS transistor whose source and gate are respectively connected to the source and gate of the first MOS transistor and is of a conductivity type that is identical to the first MOS transistor. A first resistor element and a second resistor element are connected in series between an output terminal and a second power supply line. A third resistor element is connected between a drain of the second MOS transistor and a second power supply line. An amplifier controls the first and the second MOS transistors based on a difference between potential of a connection point of the first and the second resistor elements and a reference potential, so that output potential of the output terminal is constant. A first comparator compares (a first) potential difference between two ends of the third resistor element and (a second) potential difference between a connection point of the first and the second resistor elements and the second power supply line, and in cases in which an absolute value of the (first) potential difference between the two ends of the third resistor element is larger than an absolute value of the (second) potential difference between a connection point of the first and the second resistor elements and the second power supply line, controls the first MOS transistor so as to limit a value of a load current. The first comparator is configured such that a MOS transistor at a differential amplifier input stage is of a conductivity type opposite to the first MOS transistor.

A second comparator may be provided which compares the first potential difference between two ends of the third resistor element and the second potential difference between a connection point of the first and the second resistor elements and the second power supply line, and in cases in which an absolute value of the first potential difference is larger than an absolute value of the second potential difference, and the first MOS transistor is controlled so as to limit a value of the load current. The second comparator may be configured such that a MOS transistor at a differential amplifier input stage is of a conductivity type identical to the first MOS transistor.

A fourth resistor element may be inserted between the drain of the second MOS transistor and the third resistor element. Instead of the first potential difference being inputted to the second comparator, a potential difference between the drain of the second MOS transistor and the second power supply line may be inputted.

Meritorious effect of the invention is as follows. According to the first aspect of the present invention, by comparing potential with respect to output terminal potential and potential of a resistor element for detecting overcurrent, overcurrent protection is performed. As a result, there is almost no variation in detected value of the overcurrent due to difference of individual products and temperature, and a current equivalent to a detection value of the overcurrent does not continue to flow even in a state in which there is an output short. Therefore, stable overcurrent protection is carried out.

PREFERRED MODES FOR CARRYING OUT THE INVENTION

A regulator circuit with the overcurrent protection circuit according to a mode of the present invention includes an output terminal (Vout in FIG. 1) which outputs a load current, a first MOS transistor (P1 in FIG. 1) whose source is connected to a first power supply line (wiring related to Vdd in FIG. 1), and whose drain is connected to an output terminal. A second MOS transistor (P2 in FIG. 1) is provided whose source and gate are respectively connected to the source and gate of the first MOS transistor and is of a conductivity type that is identical to the first MOS transistor. A first and a second resistor element (R1 and R2 in FIG. 1) are connected in series between the output terminal and a second power supply line; and a third resistor element (R3 in FIG. 1) is connected between a drain of the second MOS transistor and a second power supply line (wiring related to GND in FIG. 1). An amplifier (Amp in FIG. 1) controls the first and the second MOS transistors based on a difference between potential of a connection point of the first and the second resistor elements and a reference potential, so that output potential of the output terminal is constant.

Furthermore, a first comparator (Cmp1 in FIG. 1) compares (a first) potential difference between two ends of the third resistor element and (a second) potential difference between a connection point of the first and the second resistor elements and the second power supply line. In cases in which an absolute value of the (first) potential difference between the two ends of the third resistor element is larger than an absolute value of the (second) potential different between a connection point of the first and the second resistor elements and the second power supply line, the first comparator controls the first MOS transistor so as to limit a value of a load current. The first comparator is configured such that a MOS transistor at a differential amplifier input stage is of a conductivity type opposite to the first MOS transistor.

The regulator circuit of the present invention is preferably further provided with a second comparator (Cmp2 in FIG. 4) which compares (a first) potential difference between two ends of the third resistor element and (a second) potential difference between a connection point of the first and the second resistor elements and the second power supply line. In cases in which an absolute value of the (first) potential difference between the two ends of the third resistor element is larger than an absolute value of the (second) potential different between a connection point of the first and the second resistor elements and the second power supply line, the second comparator controls the first MOS transistor so as to limit a value of the load current. The second comparator is configured such that a MOS transistor at a differential amplifier input stage is of a conductivity type identical to the first MOS transistor.

The regulator circuit of the present invention may be further provided with a fourth resistor element (R5 in FIG. 7) inserted between the drain of the second MOS transistor and the third resistor element, wherein, instead of the (first) potential difference between the two ends of the third resistor element being inputted to the second comparator, a potential difference between the drain of the second MOS transistor and the second power supply line is inputted.

A detailed explanation is given below according to examples, referring to the drawings.

FIRST EXAMPLE

Figure 1:
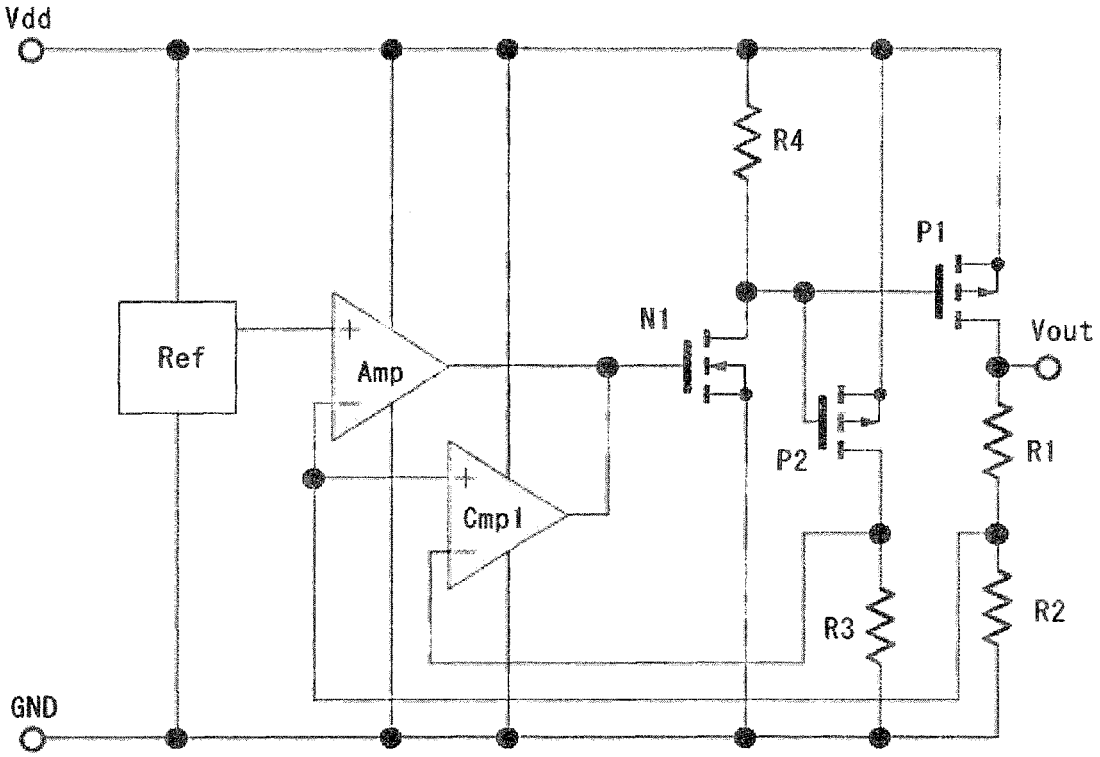
FIG. 1 is a block diagram showing a configuration of a regulator circuit with an overcurrent protection circuit according to a first example of the present invention.

FIG. 1 is block diagram showing a configuration of a regulator circuit with an overcurrent protection circuit according to a first example of the present invention. In FIG. 1, the regulator circuit with the overcurrent protection circuit is provided with a reference voltage generator Ref, an amplifier (operational amplifier) Amp, a comparator Cmp1, an Nch transistor N1, Pch transistors P1 and P2, resistor elements R1, R2, R3, and R4, a power supply terminal Vdd, a ground terminal GND, and an output terminal Vout.

The reference voltage generator Ref generates a reference voltage such as a band gap reference voltage or the like, by dropping voltage of the power supply terminal Vdd, and provides the voltage to a noninverting terminal (+) of the amplifier Amp. The amplifier Amp amplifies a difference between the reference voltage and a voltage of a connection point of the resistor elements R1 and R2, and outputs the amplified voltage to a gate of the Nch transistor N1. The comparator Cmp1 compares voltage of a connection point of the resistor elements R1 and R2 and a voltage of a connection point of a drain of the Pch transistor P2 and one end of the resistor element R3, and lowers potential of the gate of the Nch transistor N1 in accordance with a result of comparison, to ground potential. The Nch transistor N1 has a source that is grounded, and a drain that is connected via the resistor element R4 to the power supply terminal Vdd, and is connected to respective gates of the Pch transistors P1 and P2. A source of the Pch transistor P1 is connected to the power supply terminal Vdd, and a drain is connected to the output terminal Vout and one end of the resistor element R1. The other end of the resistor element R1 is connected to the other end of the resistor element R2, one end of which is grounded, an inverting terminal (−) of the amplifier Amp, and a noninverting terminal (+) of the comparator Cmp1. A source of the Pch transistor P2 is connected to the power supply terminal Vdd and a drain is connected to another end of the resistor element R2, one end of which is grounded, and to an inverting terminal (−) of the comparator Cmp1.

Figure 2:
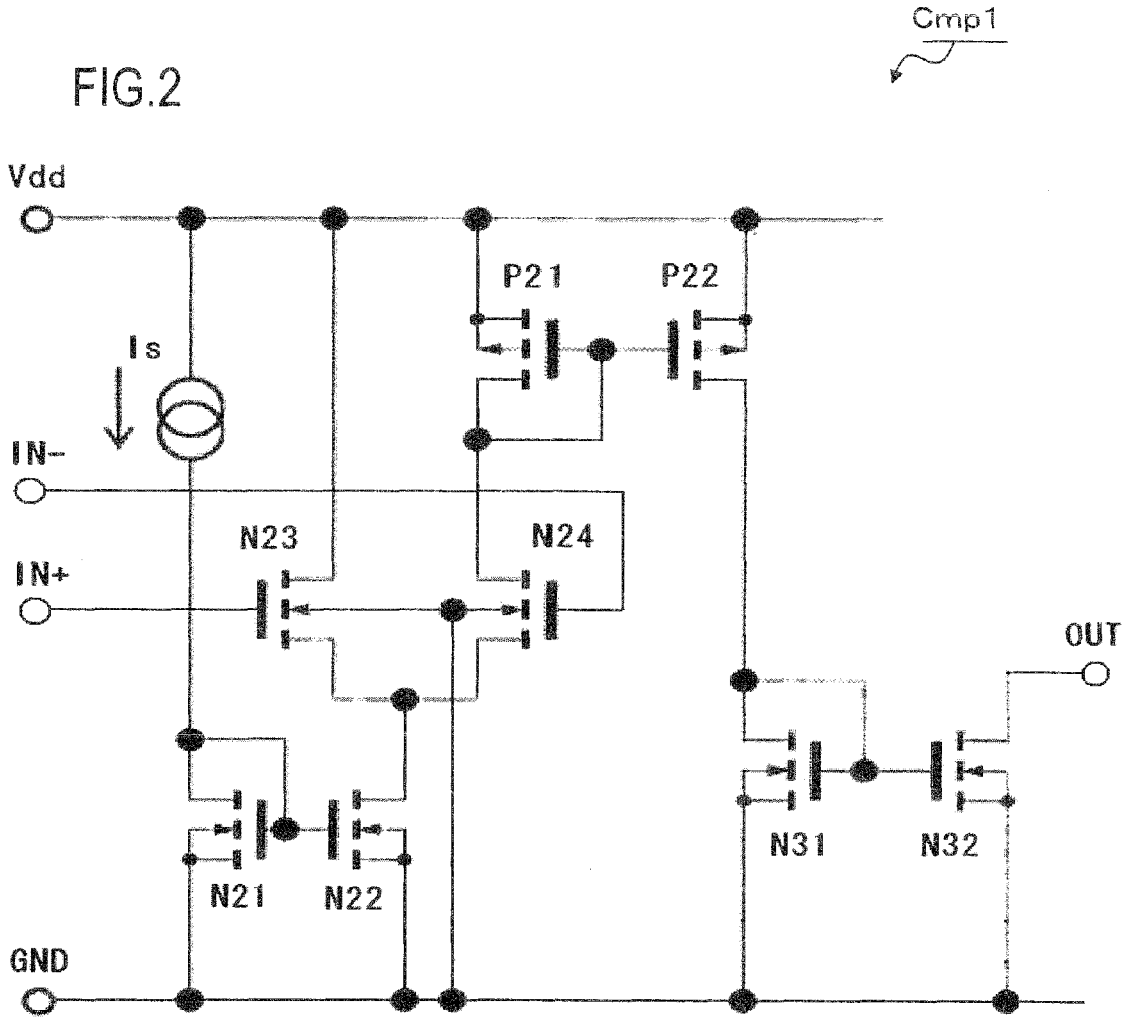
FIG. 2 is a circuit diagram of a first comparator.

FIG. 2 is circuit diagram of the comparator Cmp1. In FIG. 2, the comparator Cmp1 is provided with Nch transistors N21, N22, N23, N24, N31, and N32, Pch transistors P21 and P22, and a current supply Is. The Nch transistors N21 and N22 form a current mirror, and supply a constant current corresponding to the current supply Is, as a current supply of the Nch transistors N23 and N24 that form a differential pair. Respective gates of the Nch transistors N23 and N24 function as a noninverting terminal IN+ and an inverting terminal IN− with respect to the comparator Cmp1. The Pch transistors P21 and P22 that form a current mirror are connected to the drain of the Nch transistor N24, and the Nch transistors N31 and N32 that form a current mirror are connected to a drain of the Pch transistor P22. The drain of the Nch transistor N32 functions as an output terminal OUT of the comparator Cmp1.

The regulator circuit with the overcurrent protection circuit configured as above operates so that the noninverting terminal (+) and the inverting terminal (−) of the amplifier Amp have the same potential (termed "imaginary short"). Therefore, voltage of the connection point of the resistor elements R1 and R2 is the reference voltage, and voltage of the output terminal Vout is a voltage that is (R1+R2)/R2 times the reference voltage. This voltage is outputted from the drain of the Peh transistor P1 via the output terminal Vout to the outside.

The gates and sources of the Pch transistors P1 and P2 are commonly connected, and flowing current ratio is constant. That is, the current flowing in the Pch transistor P2 is proportional to an output current flowing in the Pch transistor P1, and the Pch transistor P2 functions as a transistor for output current detection. A current flowing in the Pch transistor P2 flows via the resistor element R3 towards ground, and a voltage for detecting output current is generated in the drain of the Pch transistor P2.

The detection value of the overcurrent is determined by a current flowing through the resistor element R2. The current flowing through the resistor element R2 is depended on voltage of the output terminal Vout. Therefore, a voltage of the connection point between resistor elements R1 and R2 is used as a voltage of detection value of the overcurrent.

In cases in which the output current value is smaller than a detection value of the overcurrent, the voltage of the drain of the Pch transistor P2, that is, of the inverting terminal (−) of the comparator Cmp1, is lower than a voltage of the connection point of the resistor elements R1 and R2, that is, of the noninverting terminal (+) of the comparator Cmp1. In such cases, output of the comparator Cmp1, the Nch transistor N32 being OFF, does not influence the potential of the gate of the Nch transistor N1.

On the other hand, in cases in which the value of the output current is larger than the detection value of the overcurrent, that is, the voltage of the inverting terminal (−) of the comparator Cmp1 is higher than the voltage of the noninverting terminal (+) of the comparator Cmp1, the Nch transistor N32 is conductive, and the potential of the gate of the Nch transistor N1 is lowered to ground potential. By the potential of the gate of the Nch transistor N1 being lowered, the current flowing in the Nch transistor N1 decreases, the gate potential of the Pch transistors P1 and P2 increases, and the current flowing in the Pch transistors P1 and P2 is limited.

Figure 3:
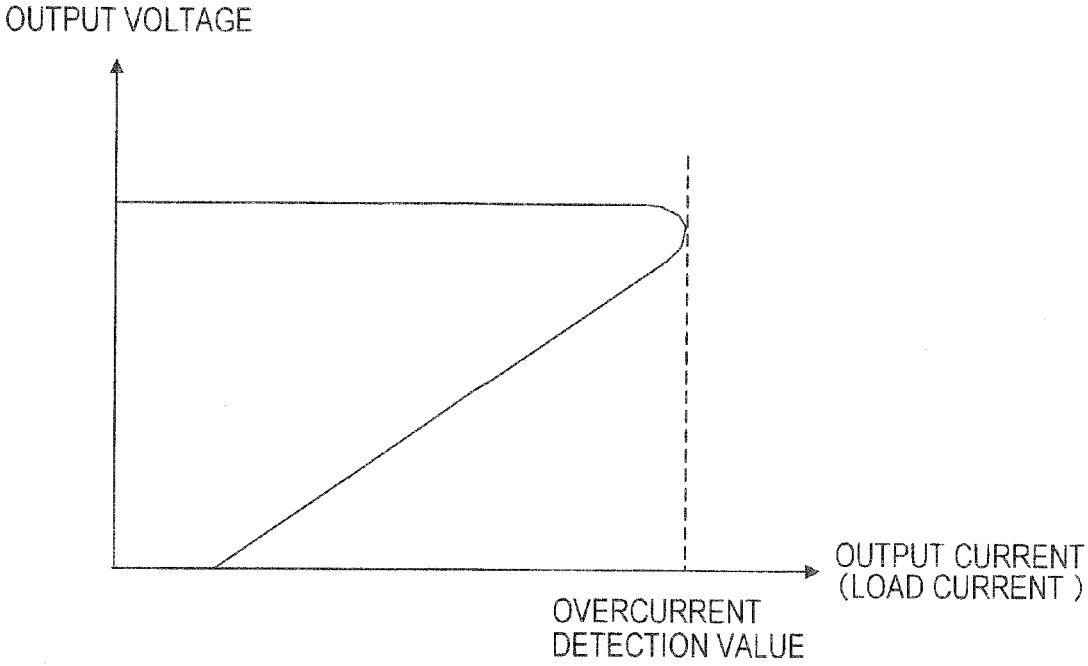
FIG. 3 shows fold-back type dropping characteristic according to the present invention.

Furthermore, in cases in which the output terminal Vout is in a short state, the voltage of the connection point of the resistors R1 and R2 decreases, and even when the voltage of the inverting terminal (−) of the comparator Cmp1 has a lower value, that is, a detection value of a smaller overcurrent, the overcurrent is limited. As a result, as an output voltage-current characteristic, a fold-back dropping type characteristic shows as shown in FIG. 3, i.e., the shape of a horizontal and a diagonal line, as in the outline of the numeral "7" (precisely of Japanese Katakan "Fu", that depicts like the first and second strokes of large alphabet "Z" except the bottom stroke.), is formed.

According to the overcurrent protection circuit that operates as above, the detection value of the overcurrent is made constant by the reference voltage. Therefore, there are almost no variations in the detection value of the overcurrent due to differences in individual products and temperature, and even in a state in which there is an output short, a current equivalent to a detection value of the overcurrent does not continue to flow.

Furthermore, even in cases in which the power supply voltage is a low voltage, since the differential amplifier input stage of the comparator Cmp1 is configured by an Nch transistor, operation is performed with voltage between gate and source almost constant. Therefore, when a large output current flows, the overcurrent protection circuit operates normally. That is, in the differential amplifier input stage of an Nch transistor configuration, a feedback voltage is inputted to the gate in the same way. However, even when the source is close to ground potential and the power supply voltage is low, the voltage between gate and source that influences operation is constant. As a result, the protection circuit does not receive a large effect, and operates normally.

SECOND EXAMPLE

Figure 4:
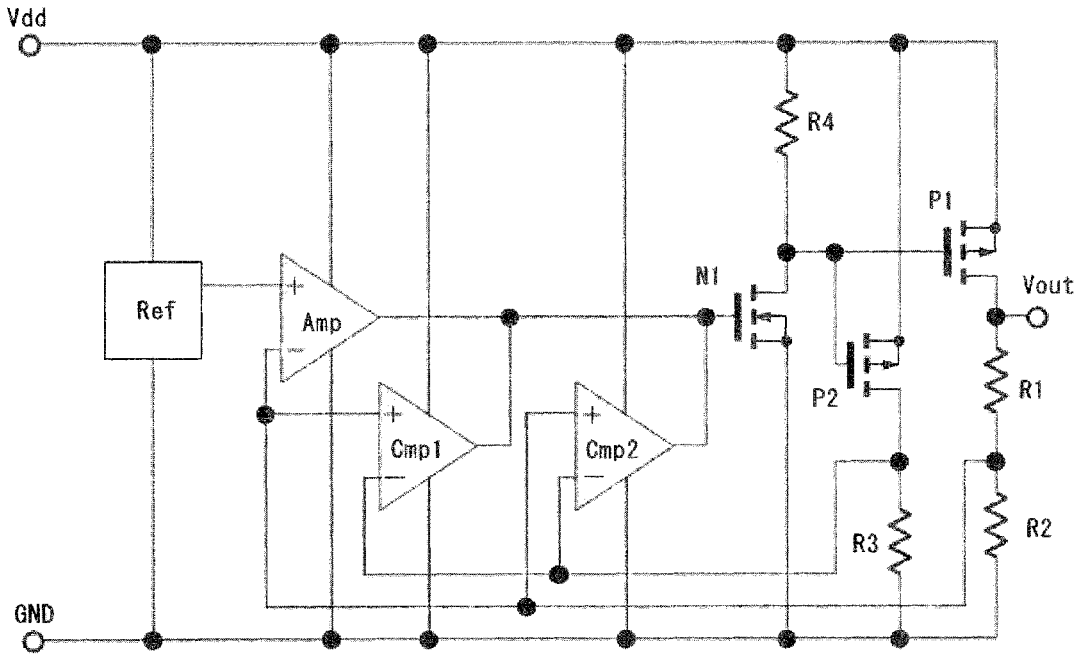
FIG. 4 is a block diagram showing a configuration of a regulator circuit with an overcurrent protection circuit according to a second example of the present invention.

FIG. 4 is a block diagram showing a configuration of a regulator circuit with an overcurrent protection circuit according to a second example of the present invention. In FIG. 4, references symbols that are the same as in FIG. 1 represent the same items, and explanations thereof are omitted. In comparison to FIG. 1, a comparator Cmp2 for overcurrent detection is newly added in the overcurrent protection circuit of FIG. 4. A noninverting terminal (+), an inverting terminal (−), and an output terminal of the comparator Cmp2 are respectively connected to a noninverting terminal (+), an inverting terminal (−), and an output terminal of comparator Cmp1. Moreover, in the comparator Cmp2, a differential input transistor is configured by a Pch transistor.

Figure 5:
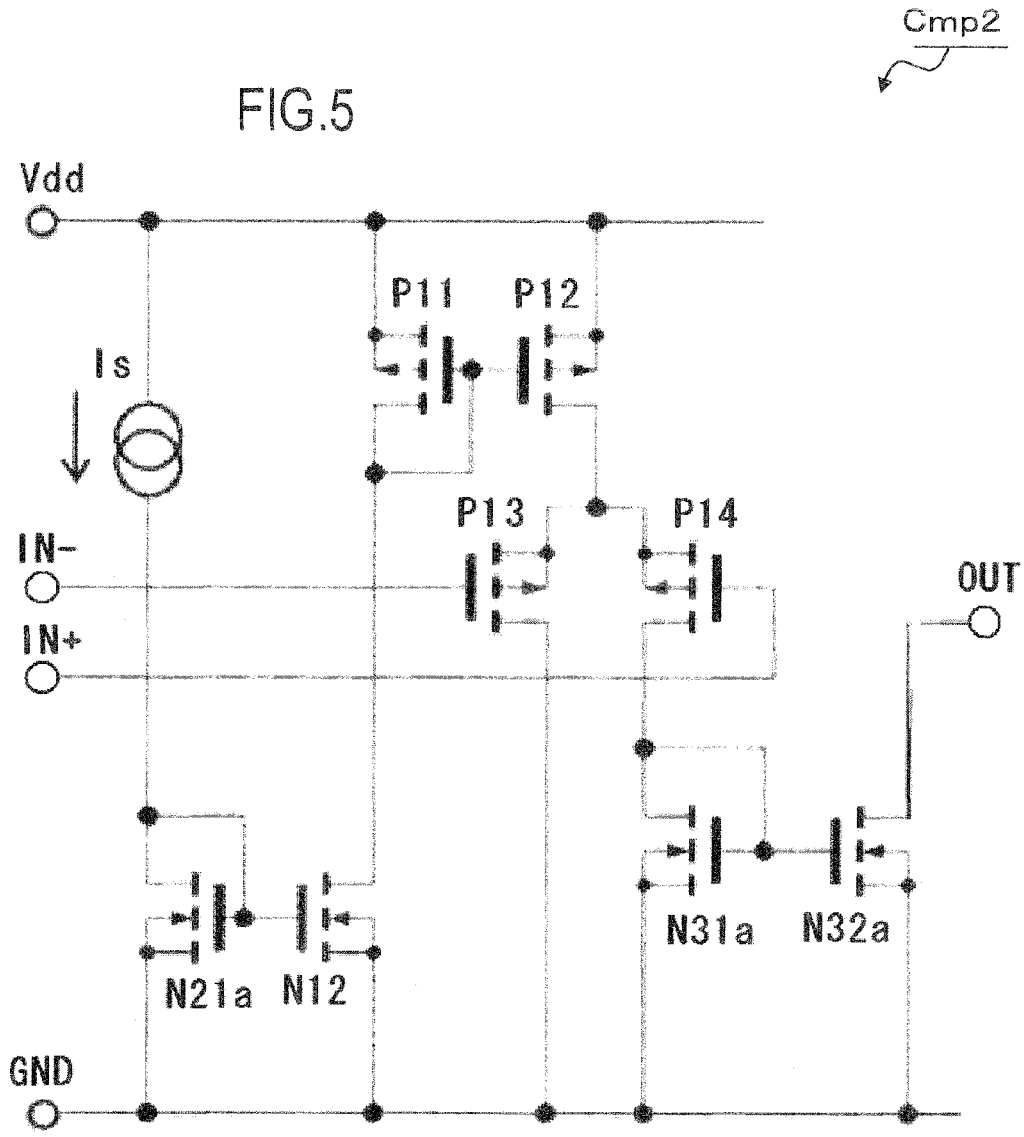
FIG. 5 is a circuit diagram of a second comparator.

FIG. 5 is a circuit diagram of the comparator Cmp2. In FIG. 5, the comparator Cmp2 is provided with Nch transistors N21*a*, N12, N31*a*, and N32*a*, Pch transistors P11, P12, P13, and P14, and a current supply Is. The Nch transistors N21*a* and N12 form a current mirror, and a constant current corresponding to the current supply Is flows in the Pch transistors P11 and P12 that form a current mirror. The Pch transistors P11 and P12 that form the current mirror turn this current around, to supply current, as a current supply, to the Pch transistors P13 and P14 that form a differential pair. The respective gates of the Pch transistors P13 and P14 function as an inverting terminal IN− and a noninverting terminal IN+ of the comparator Cmp2. The Nch transistor N3 La and N32*a* that form a current mirror are connected to a drain of the Pch transistor P14. The drain of the Nch transistor N32*a* functions as an output terminal OUT of the comparator Cmp2.

Figure 6:
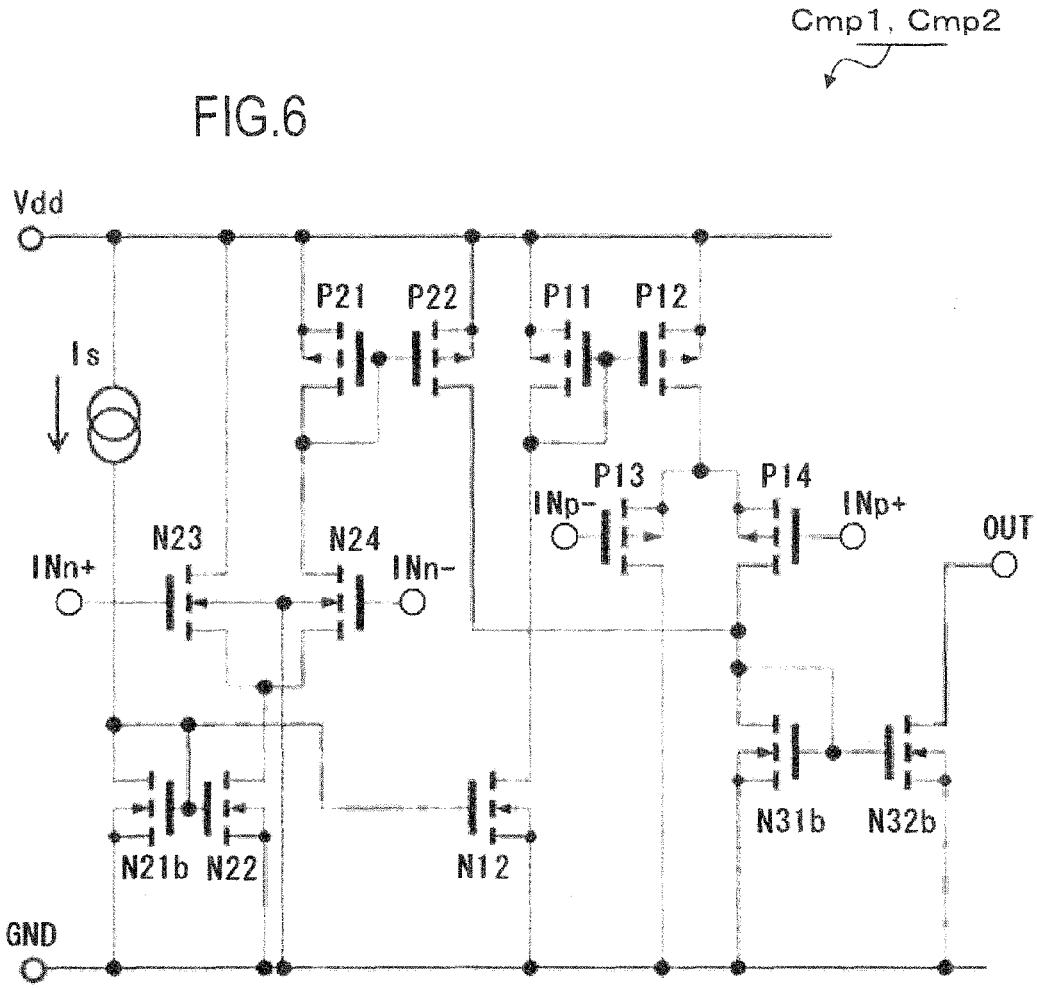
FIG. 6 is a circuit diagram of a comparator combining the first and the second comparators.

FIG. 6 is a circuit diagram of a comparator in which the comparators Cmp1 and Cmp2 are combined. By common usage of common portions of the comparator Cmp1 shown in FIG. 2 and comparator Cmp2 shown in FIG. 5, it is possible to simplify the circuit. That is, the current supply Is of FIG. 2 and FIG. 5 can be shared, and the Nch transistor N21 of FIG. 2 and the Nch transistor N21*a* of FIG. 5 can be shared as the Nch transistor N21*b*. Furthermore, the Nch transistors N31 and N32 that form a current mirror in FIG. 2, and the Nch transistors N31*a* and N32*a* that form a current mirror in FIG. 5 can be shared as the Nch transistors N31*b* and N32*b* that form a current mirror.

The regulator circuit with the overcurrent protection circuit configured as above operates similarly to the regulator circuit with the overcurrent protection circuit of the first example. Furthermore, by providing both the comparator Cmp1 that has differential input by the Nch transistor, and the comparator Cmp2 that has differential input by the Pch transistor, as the overcurrent protection circuit, it is possible to operate more stably, from the power supply voltage having a high voltage to low voltage.

THIRD EXAMPLE

Figure 7:
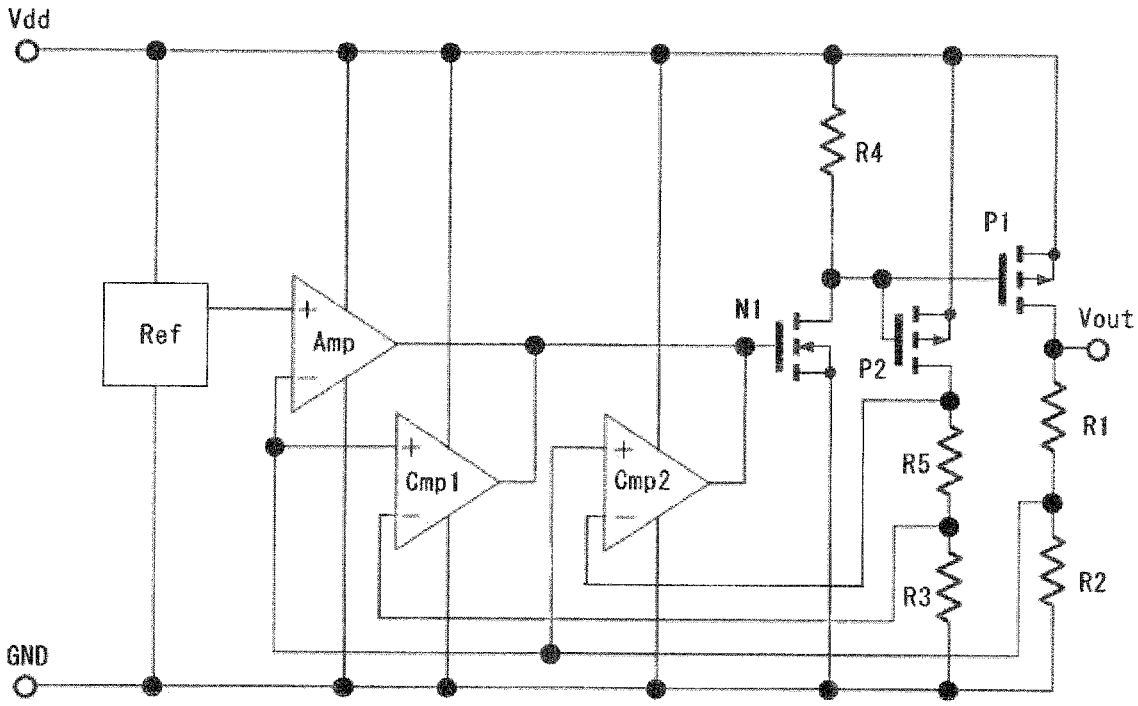
FIG. 7 is a block diagram showing a configuration of a regulator circuit with an overcurrent protection circuit according to a third example of the present invention.
Figure 8:
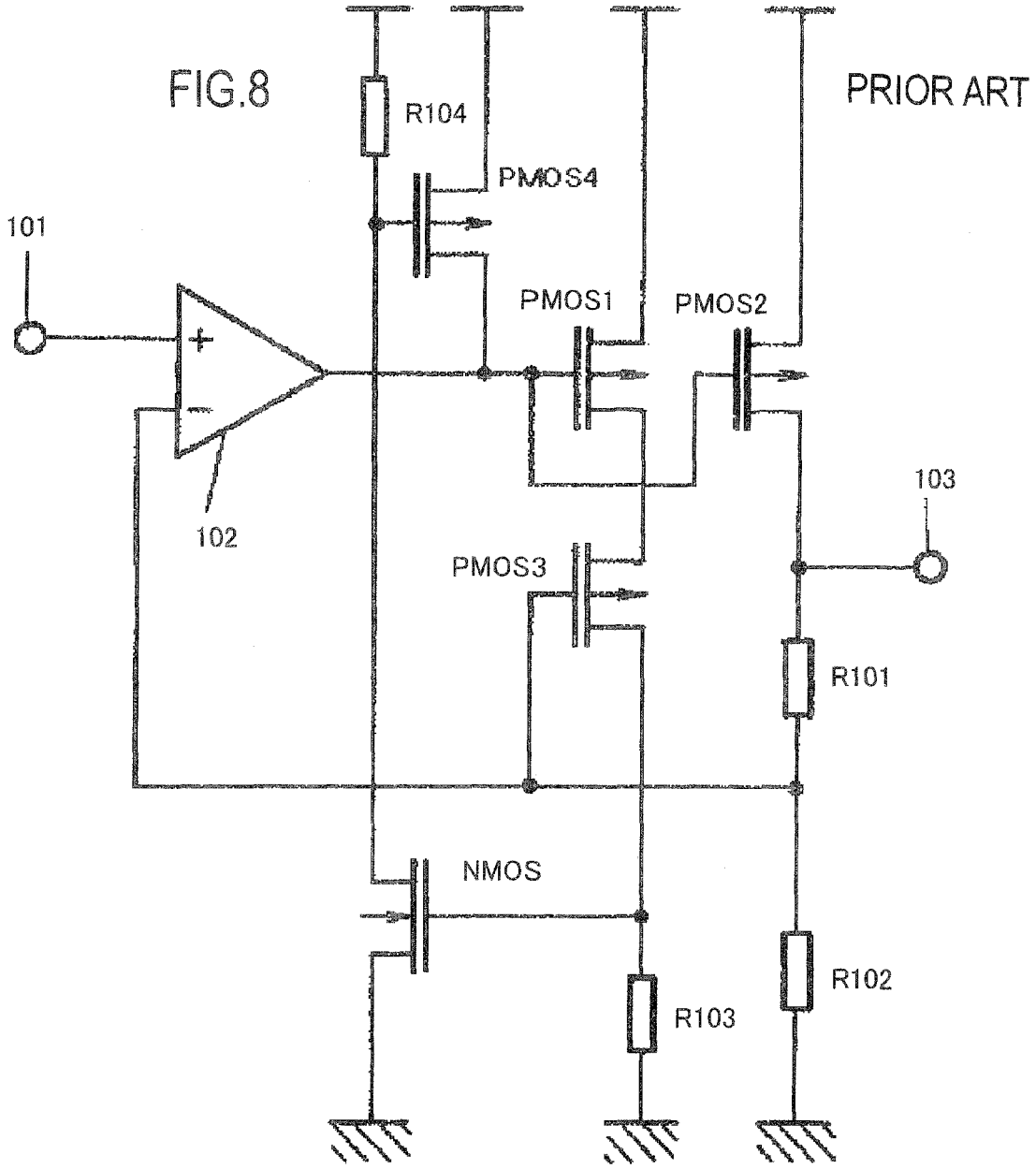
FIG.8 PRIOR ART
FIG. 8 is a circuit diagram of a conventional regulator circuit with overcurrent protection circuit.

FIG. 7 is a block diagram showing a configuration of a regulator circuit with an overcurrent protection circuit according to a third example of the present invention. In FIG. 7, references symbols that are the same as in FIG. 4 represent the same items, and explanations thereof are omitted. In the regulator circuit with the overcurrent protection circuit shown in FIG. 7, in comparison to FIG. 4, a resistor element R5 is inserted between a drain of a Pch transistor P2 and the other end of a resistor element R3. A connection point of the drain of the Pch transistor P2 and the resistor element R5 is connected to an inverting terminal (−) of a comparator Cmp2.

According to the regulator circuit with the overcurrent protection circuit of this type of configuration, it is possible to set each of overcurrent detection values (overcurrent protection detection points) for comparators Cmp1 and Cmp2 respectively. Therefore, by suitably setting the overcurrent limit points, design freedom is increased. For example, it is possible to change the characteristic shape of a current limitation region, a fold-back dropping characteristic, indicating an output voltage-current characteristic.

The present invention as described above has been explained according to the abovementioned examples, but the invention is not limited to the abovementioned examples, and various types of modifications and adjustments are included, as can be envisioned by a person skilled in the art, within the scope of each of the claims of the present application.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A regulator circuit, comprising:

a first MOS transistor, whose source is connected to a first power supply line, whose drain is connected to an output terminal;

a second MOS transistor of a conductivity type identical to the first MOS transistor, whose source and gate are respectively connected to the source and gate of the first MOS transistor;

first and second resistor elements connected in series between the output terminal and a second power supply line;

a third resistor element connected between a drain of the second MOS transistor and the second power supply line;

an amplifier which controls the first and the second MOS transistors based on a difference between potential of the connection point of the first and the second resistor elements and a reference potential, so that output potential of the output terminal is constant; and a first comparator which compares a first potential difference between two ends of the third resistor element and a second potential difference between a connection point of the first and the second resistor elements and the second power supply line, and in cases in which an absolute value of the first potential difference is larger than an absolute value of the second potential difference, controls the first MOS transistor so as to limit a value of a load current, wherein the first comparator is configured such that a MOS transistor at a differential amplifier input stage is of a conductivity type opposite to the first MOS transistor, and the outputs of the amplifier and first comparator are connected together.

2. A regulator circuit according to claim 1, further comprising:

a second comparator which compares one of the first potential difference and a potential difference between the drain of the second MOS transistor and the second power supply line with the second potential difference, and in cases in which an absolute value of the first potential difference is larger than an absolute value of the second potential difference, controls the first MOS transistor so as to limit a value of the load current, wherein the second comparator is configured such that a MOS transistor at a differential amplifier input stage is of a conductivity type identical to the first MOS transistor.

3. A regulator circuit according to claim 2, further comprising:

a fourth resistor element inserted between the drain of the second MOS transistor and the third resistor element.

4. A regulator circuit, comprising:

a first transistor connected between a first power supply line and an output terminal;

a first resistor element connected between the output terminal and a second power supply line;

a second transistor and a second resistor element connected in series between the first and second power supply lines;

a first comparator comparing an output voltage and a reference voltage to control the first and second transistors; and a second comparator comparing a first current flowing through the first resistor element and a second current flowing through the second resistor element, and controlling the first and second transistor, wherein outputs of the first and second comparators are connected together.

* * * * *